US005133311A

United States Patent [19]

Hallgren

[11] Patent Number: 5,133,311

[45] Date of Patent: Jul. 28, 1992

[54] AUXILIARY CONTROL UNIT

[75] Inventor: Viking Hallgren, Stenungsund, Sweden

[73] Assignee: AB Volvo, Goteborg, Sweden

[21] Appl. No.: 687,929

[22] PCT Filed: Dec. 6, 1989

[86] PCT No.: PCT/SE89/00714

§ 371 Date: Jul. 23, 1991

§ 102(e) Date: Jul. 23, 1991

[87] PCT Pub. No.: WO90/06429

PCT Pub. Date: Jun. 14, 1990

[30] Foreign Application Priority Data

Dec. 6, 1988 [SE] Sweden ..... 8804405-2

[51] Int. Cl.[5] ..... F02D 41/06

[52] U.S. Cl. ..... 125/179.1; 123/179.15; 123/179.16; 123/491

[58] Field of Search ..... 123/179.1, 179.3, 179.13, 123/179.15, 179.16, 491, 179.17, 179.18

[56] References Cited

U.S. PATENT DOCUMENTS 3,705,571 12/1972 Horn et al. ..... 123/491
4,089,317 5/1978 Drews et al. ..... 123/179.17
4,132,210 1/1979 Long ..... 123/491
4,205,635 6/1980 Kirn et al. ..... 123/491
4,437,445 3/1984 Takahashi et al. ..... 123/179.16

FOREIGN PATENT DOCUMENTS 3609600 9/1987 Fed. Rep. of Germany .
2194356 3/1988 United Kingdom .

*Primary Examiner*—Andrew M. Dolinar
*Attorney, Agent, or Firm*—Young & Thomspon

[57] ABSTRACT

The invention relates to an auxiliary unit included in a control arrangement for an internal combustion engine. An NTC-resistor (6) which is subjected to the effect of engine temperature of engine cooling-water temperature, is connected to a control system (5) which monitors the resistance of the NTC-resistor (6), this resistance varying with engine temperature, and utilizes this variation in resistance to change temperature-dependent control parameters for engine operation. The auxiliary control unit is connected to NTC-resistor (6). The auxiliary control unit applies an elevated voltage across the NTC-resistor over a predetermined period of time after an engine cold start, so as to deceive the control system (5) in indicating that the resistor is colder than it actually is.

9 Claims, 2 Drawing Sheets

AUXILIARY CONTROL UNIT

The present invention relates to a control unit and more particularly to an auxiliary control unit which is connected to a resistor having a high-temperature coefficient used to detect the engine temperature or the temperature of the engine coolant, and which coacts with a control system which functions to adapt the fuel-injection and timing of the engine while driving the engine until the engine is warm.

An engine which is equipped with this type of control system incorporating an NTC-resistor (negative temperature coefficient) will normally start easily within a normal operating range of between +5° C. and +20° C. Problems occur, however, when the engine is subjected to load immediately upon being started-up, for instance when the driver of the vehicle moves the gear into drive and commences to drive the vehicle immediately, or when the air condition system is operative or the servo pump is working The engine will then tend to die, therewith necessitating a restart. This is said to be due to a combination of factors relating to engine temperature, poor fuel supply and, in some cases, fuel starvation due, inter alia, to carbon deposits on the suction valve.

In accordance with the invention, this problem is solved by providing an auxiliary control unit having the characteristic features set forth below.

Figure 1:
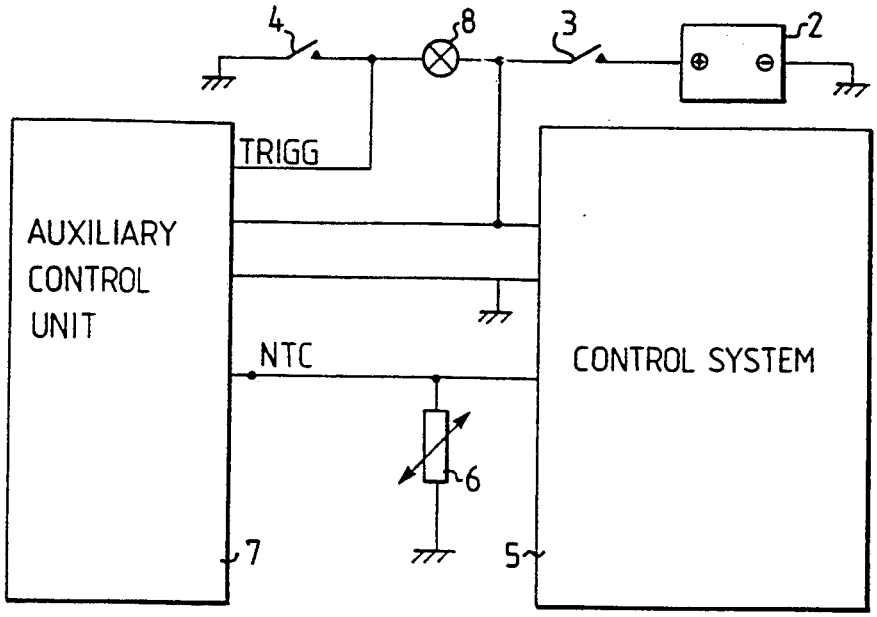
Figure 2:
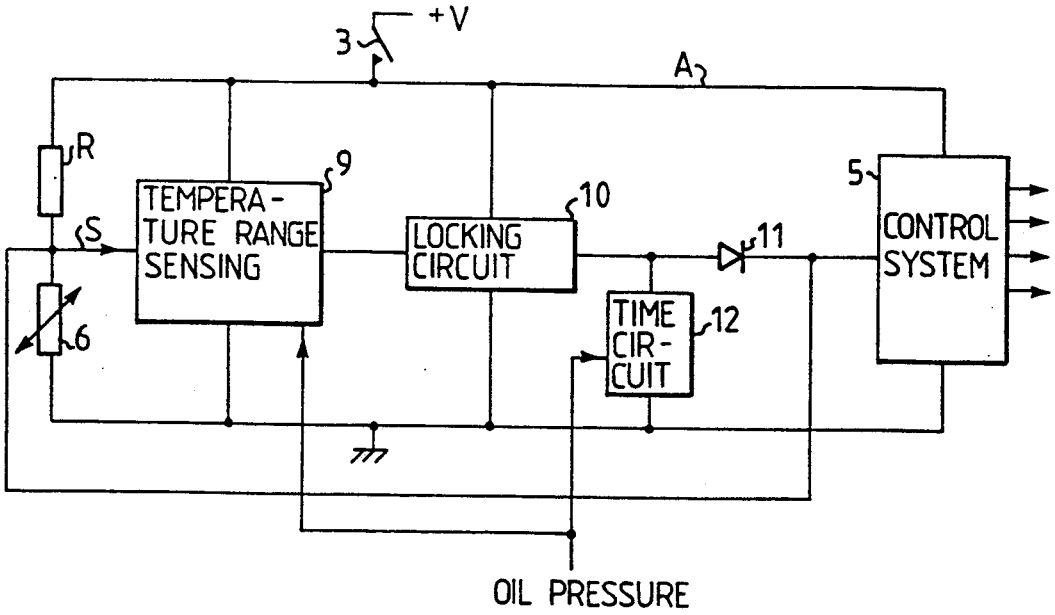
Figure 3:
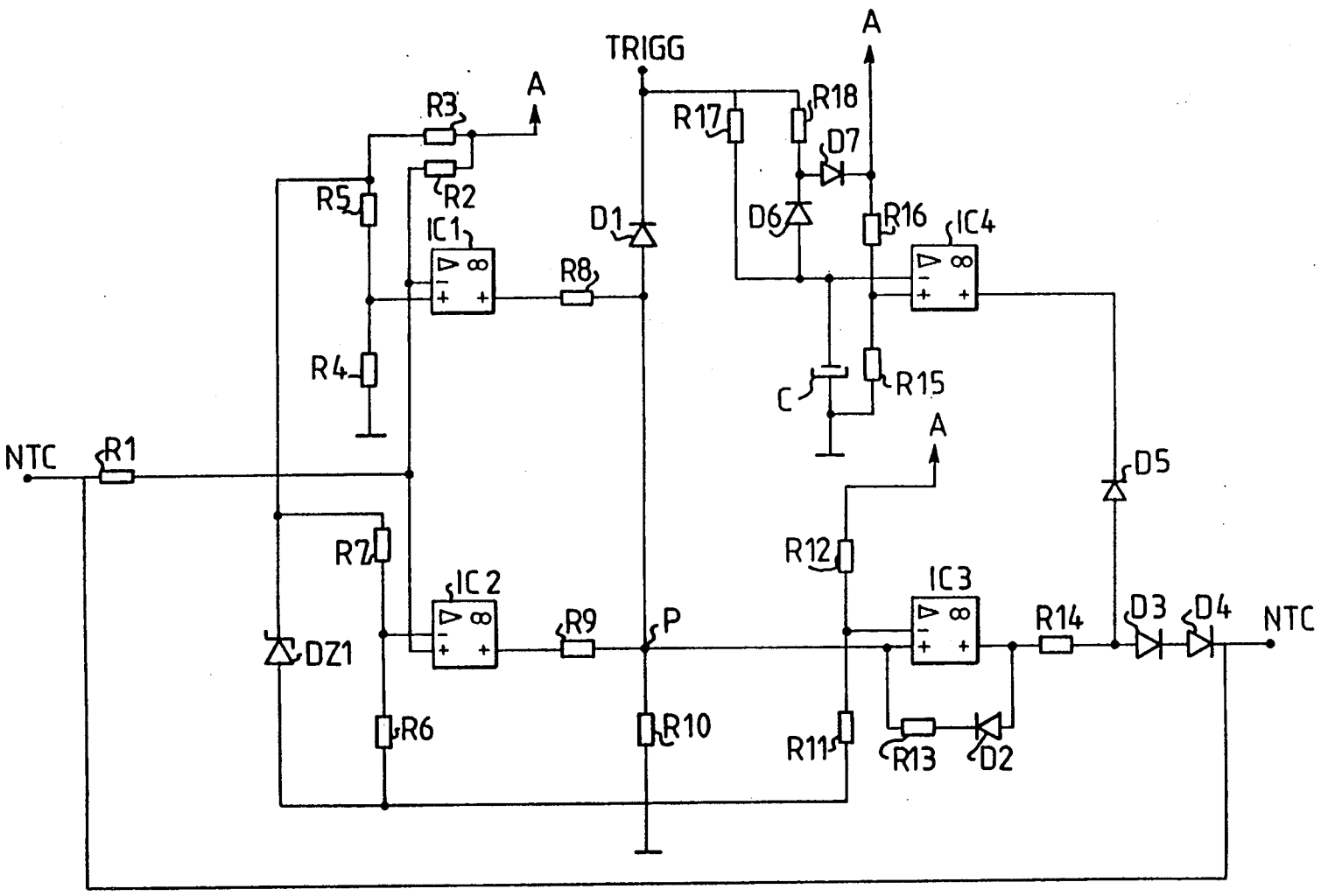

The invention will now be described in more detail with reference to the accompanying drawings, in which FIG. 1 illustrates very schematically in block form a control system for an internal combustion engine and shows the location of the inventive auxiliary control unit;

FIG. 2 is a block schematic of one embodiment of the inventive auxiliary control unit; and FIG. 3 illustrates the circuitry of one embodiment of the inventive auxiliary control unit.

Like components have been identified with like reference signs in all three figures of the drawings.

In the arrangement illustrated in FIG. 1, the positive terminal of a battery 2 is connected to the voltage supply of a conventional vehicle-engine control system 5, via an ignition lock switch 3 The control system 5 is operative to control the amount of fuel delivered to the engine and is connected to an engine temperature sensor or an engine coolant sensor in the form of a resistor 6 having a high temperature coefficient. The resistor used will normally have a negative temperature coefficient, known as an NTC-resistor, although the use of a resistor which has a positive temperature coefficient is not excluded. The output signals of the control system are functions, inter alia, of the temperature detected by the resistor 6.

In accordance with the invention, an auxiliary control unit 7 is also connected to the resistor 6. Voltage is supplied to the auxiliary control unit 7 in the same manner as that in which voltage is supplied to the control system 5, and the auxiliary control unit 7 has an input TRIGG, which in the case of the illustrated embodiment is connected to the oil-pressure monitor-switch 4 of the engine, this monitor-switch being connected to the positive terminal of the battery via an oil-pressure lamp 8 and the aforesaidignition lock 3. When the oil-pressure monitor-switch is broken, the oil-pressure lamp 8 is extinguished and the potential on the input TRIGG will therefore be high, therewith triggering the inventive auxiliary control unit.

The significant factor with the signal TRIGG is that the engine will have started before the auxiliary control unit is triggered. This is necessary in order to prevent an erroneous NTC-voltage from deceiving the λ-probe integrator, i.e. when a temperature beneath about 14° C. is registered at the very moment of starting the engine, the probe-start is delayed, resulting in emission problems. Generator voltage, engine speed etc. may also constitute trigger parameters which can be used in the present context, i.e. other than oil-pressure.

In accordance with the present invention, on the occurrence of a cold engine-start, where the temperature of the engine is, for instance, between +5° C. and +30° C., the voltage across the resistor 6 is changed to a value which indicates to the control system 5 that the resistor 6 is colder than it actually is, and the control system causes the output signals thereof to change accordingly. Thus, when the resistor 6 is an NTC-resistor, the voltage shall be raised. The control system 5 of several models of vehicle has separate control functions which become operative when the engine 1 has a lower temperature than about +5° C. These separate control functions must not be interferred separate control functions must not be interferred with. When the engine 1 has a temperature higher than about +30° C., the engine is sufficiently hot to obviate the need of the additional function afforded by the auxiliary control unit 7.

This additional function corresponds to the function of an additional choke and will therefore only remain operative for a predetermined length of time subsequent to starting the engine. This time period may be in the order of 60 seconds and is not commenced until the oil pressure has reached its set-point value, i.e. when the voltage TRIGG is high and the lamp 8 is extinguished.

The elevated voltage across the resistor 6 during said predetermined time period may, for instance, be essentially the same over the whole of the temperature range +5° to +30° C., which enables the circuit required to be given a simple construction, or alternatively the voltage increase may be essentially constant, i.e. different elevated voltages may occur over said temperature range. For instance, when the engine temperature is +15° C. and the voltage across the NTC-resistor is increased by 0.5 V, the control system 5 will function as though the engine temperature were about 10° C. lower than it actually is.

FIG. 2 illustrates schematically an embodiment of a circuit which will provide an essentially constant increased voltage during the period in which it is active. The circuit is a series-coupling consisting of the NTC-resistor 6 and a resistor R connected between the positive-conductor A and earth. When the ignition lock switch 3 is made, the voltage S across the NTC-resistor 6 is sensed by a sensor 9. When the voltage S lies within a range which indicates a resistance of the NTC-resistor corresponding to the temperature range of +5±0.1° C. and +30±0.1° C., the sensor 9 produces an output signal, which is sent to a locking circuit 10. The circuit 10 normally has a low output signal. When receiving the signal from the sensor 9, the output signal of the locking circuit is switched to a high value. The output signal of the locking circuit is thereafter locked in this state. A diode 11 is connected between the output of the locking circuit 10 and the NTC-resistor, and is so directed that the voltage on the output of the locking circuit will only influence the voltage across the NTC-resistor 6 when said voltage is high. A time circuit 12 is connected between the output of the locking circuit 10 and earth. This time circuit is normally non-conductive and is triggered when the oil-pressure voltage becomes high. When a set time period has lapsed after the trigger signal, e.g. 60 seconds, the time circuit is switched to a conductive state, such that the output signal of the locking circuit will obtain a low voltage level via the time circuit, and thereafter retain its conductive state until the supply of voltage to the auxiliary control unit 7 is switched off or until the oil-pressure voltage becomes low.

The auxiliary control unit 9-12 according to the invention is constantly connected to the NTC-resistor. The time circuit 12 is started automatically when triggering takes place, irrespective of the state of the locking-circuit output. Consequently, when a start takes place at a temperature which is lower than about +5° C. and the engine temperature lies within the range of +5° C. to +30° C. within the 60 second time period set on the time circuit, the inventive auxiliary control unit will be activated during the remainder of this set time-period.

FIG. 3 illustrates an embodiment of a circuit according to FIG. 2. The NTC-resistor is connected to the conductor A via the series-resistors R1 and R2, and the conductor A is connected to the positive terminal of the battery (not shown in FIG. 3) via the ignition lock switch 3. The junction between the resistors R1 and R2 is connected to the (−)-input of a first comparator IC1 and to the (+)-input of a second comparator IC2. All of the comparators included in the circuit have voltage supply between earth and the conductor A, although this is not shown separately.

A series-coupling comprising a zener diode DZ1 and a resistor R3 is connected between earth and the conductor A. A voltage divider having resistances R4 and R5 is connected across the zener diode DZ1 and the output of the voltage divider is connected to the (+)-input of the comparator IC1. The voltage divider is dimensioned so that the comparator IC1 will produce a high signal when the resistance of the NTC-resistor corresponds to a temperature higher than +5±0.1° C. This tolerance factor of 0.1° C. is mainly due to the fact that the NTC-resistor used in this context is permitted to have a relatively wide tolerance range.

A voltage divider with resistors R6 and R7 is also connected across the zener diode DZl. Its output is connected to the (−)-input of the comparator IC2. The resistors R6 and R7 are dimensioned so that the output of the comparator IC2 will only be high when the NTC-resistor is subjected to a temperature beneath +30° C.±0.1° C.

The outputs of the comparators IC1 and IC2 are connected together via respective resistors R8 and R9. The junction P is connected to the (+)-input of a third comparator IC3. The point P is also connected to earth, via a resistor R10, and also to the oil-pressure monitor-switch, via a diode D1. Consequently, the junction P is always connected to earth via the oil-pressure monitor-switch, prior to the engine oil-pressure rising to its set-point value.

The (−)-input of the comparator IC3 is connected to the output of a voltage divider R11 and R12 which is connected between earth and the conductor A. This dimensioning is not particularly critical, since the function of the comparator IC3 is merely to distinguish between a high or low potential at the junction P, i.e. to discern when the outputs of both comparators IC1 and IC2 are high and the oil monitor-switch is activated, or when any one of these signals deviates.

As soon as the junction P has a high level, the comparator IC3 switches its output from a low to a high level. A series-coupling comprising a diode D2 and a resistor R13 connected between the output and the (+)-input of the comparator locks the comparator output at a high level once having been switched. Thus, the comparator IC3 cannot be switched again to a low output signal before voltage supply to the auxiliary control unit is interrupted. The output of the comparator IC3 is connected to the NTC-resistor via a resistor R14 and two series-connected diodes D3 and D4, and is operative to raise the voltage across the NTC-resistor when its output has a high voltage level. The output of the comparator IC3 can, in this instance, be considered to form a constant voltage source and the resistor R14 and the NTC-resistor can be considered to form a voltage divider. The relationships between the resistances of R14 and the NTC-resistor can be selected so as to obtain essentially the desired nature of voltage increase across the NTC-resistor.

In the case of the illustrated embodiment, the time circuit includes a fourth comparator IC4, the (+)-input of which is connected to the output of a voltage divider R15 and R16 which in turn is connected between earth and the conductor A.

This output has a relatively high voltage level. The (−)-output of the fourth comparator IC4 is connected to the output of a series-coupling comprising a capacitor C of high capacitance and a resistor R17 connected between earth and the input "TRIGG". When the input "TRIGG" goes high, the capacitor C is slowly charged. The capacitor C and the resistor R17 are dimensioned so that the potential on the (−)-input of the fourth comparator IC4 reaches the potential on its (+)-input after about 60 seconds. At the end of this time period, the comparator IC4 switches its output from a high level to a low level. The output of the comparator IC3 is then connected to this low voltage level, via the resistor R14 and a diode D5 located between the resistor R14 and the output of the fourth comparator IC4. The potential on the junction between the resistor R14 and the diode D3 will then be low. The elevated voltage across the NTC-resistor then ceases.

A safety circuit which functions to protect the comparator IC4 against back current caused by transients includes a series-coupling comprising a diode D6 and a resistor R18 connected across the resistor R17. A diode D7 is connected between the junction between the diode D6 and the resistor R18 and the conductor A.

It will be understood that many modifications can be made within the scope of the invention. For instance, the time circuit may have a configuration different to that illustrated in FIG. 3. Instead of connecting a capacitor C so that said capacitor will be charged to a disconnect-potential subsequent to receiving a triggering signal, the capacitor can be connected so as to be charged quickly and immediately voltage is applied to the circuit and then caused to discharge slowly upon receipt of a triggering signal. The capacitor included in the time circuit may also be connected to the (+)-conductor A instead of being connected to earth.

I claim:

1. An auxiliary control unit included in a control arrangement for an internal combustion engine in which a resistor (6) subjected to engine temperature or cooling-water temperature is connected to a control system (5) which monitors the variation of the resistance of the resistor (6) with engine temperature and utilizes this resistance variation for changing temperature-dependent control parameters for engine operation, characterized in that the auxiliary control unit is connected to the resistor (6) and, over a predetermined time interval after an engine cold-start, is operative to set a changed voltage across the resistor to a value which indicates to the control system (5) that the resistor (6) is colder than it actually is.

2. An auxiliary unit according to claim 1, where the resistor is an NTC-resistor, characterized in that the auxiliary control unit is operative to apply an elevated voltage across the resistor during said predetermined time period.

3. An auxiliary unit according to claim 1, characterized in that the predetermined time period is initiated by an external signal (TRIGG) which is produced subsequent to an engine start.

4. An auxiliary unit according to claim 1, characterized in that the auxiliary control unit is intended to come into operation solely when the voltage across the resistor, as detected prior to its coming into operation, indicates that the temperature of the resistor exceeds a predetermined lowest temperature, e.g. +5° C.

5. An auxiliary unit according to claim 1, characterized in that the auxiliary control unit is intended to come into operation solely when the voltage across the resistor, as detected before coming into operation, indicates that the temperature of the resistor is beneath a predetermined highest temperature, for instance +30° C.

6. An auxiliary unit according to claim 1, characterized in that the changed voltage is an approximately constant voltage-change in relation to the voltage normally prevailing across the resistor.

7. An auxiliary unit according to claim 1, characterized in that the changed voltage is approximately constant and is independent of the voltage which normally prevails across the resistor.

8. An auxiliary unit according to claim 7, characterized by a detecting circuit (9; IC1, IC2) connected to the resistor (6; NTC) such as to detect, on the basis of the resistance of said resistor, whether its temperature lies within a temperature range in which the auxiliary control unit shall be brought into operation, and if such is the case to produce an output signal on a locking circuit (10; IC3, D2, R13) connected to the output of the detecting circuit, such as to lock said circuit in a state which gives the changed voltage across the resistor subsequent to receipt of a signal from the detecting circuit, the output of the locking circuit being connected to the resistor (6; NTC), and by a time circuit (12; IC4, C, R17) connected to the output of the locking circuit, said time circuit functioning to interrupt the effect of the locking-circuit output on the resistor subsequent to the lapse of a predetermined time period after triggering of said locking circuit.

9. An auxiliary unit according to claim 8, characterized in that the trigger-input of the time circuit is connected to a unit which produces a signal after the engine has been started, for instance, the oil-pressure monitor-switch of the engine.

* * * * *